US005771811A

United States Patent [19]

Siler et al.

[11] Patent Number: 5,771,811

[45] Date of Patent: Jun. 30, 1998

[54] PRE-REGISTRATION SYSTEM FOR A PRINTING PRESS

[75] Inventors: Steven J. Siler, Cary; Scott T. Hilkert, Skokie; Jeffrey C. Petrin, Arlington Heights, all of Ill.

[73] Assignee: Hurletron, Incorporated, Danville, Ill.

[21] Appl. No.: 728,203

[22] Filed: Oct. 10, 1996

[51] Int. Cl.[6] ..... B41F 13/24

[52] U.S. Cl. ..... 101/486; 101/181; 101/248

[58] Field of Search ..... 101/181, 211, 101/216, 248, 486; 364/469.04; 318/603, 640; 250/559.29, 559.44

[56] References Cited

U.S. PATENT DOCUMENTS

| | | | |
|---|---|---|---|
| 1,151,461 | 8/1915 | Hatt . | |
| 3,073,997 | 1/1963 | Tagliasacchi | 318/85 |
| 3,468,201 | 9/1969 | Adamson et al. | 83/74 |
| 3,561,654 | 2/1971 | Greiner | 226/25 |
| 3,601,587 | 8/1971 | Thiede | 101/181 |
| 3,915,090 | 10/1975 | Horst et al. | 101/426 |
| 3,963,902 | 6/1976 | Dowd | 101/181 |
| 3,974,766 | 8/1976 | Zimmer | 101/129 |
| 3,998,156 | 12/1976 | Zimmer | 101/115 |
| 4,033,259 | 7/1977 | Schuhmann | 101/174 |
| 4,135,664 | 1/1979 | Resh . | |
| 4,164,184 | 8/1979 | Vertegaal | 101/127.1 |
| 4,165,465 | 8/1979 | Kanatani et al. | 250/559 |
| 4,243,925 | 1/1981 | Gnuechtel | 318/603 |
| 4,366,542 | 12/1982 | Anselrode | 364/469 |
| 4,366,753 | 1/1983 | Glanz | 101/181 |
| 4,391,190 | 7/1983 | Metzler | 101/211 |
| 4,437,402 | 3/1984 | Fischer | 101/181 |
| 4,484,522 | 11/1984 | Simeth | 101/248 |
| 4,485,447 | 11/1984 | Ericsson | 364/469 |
| 4,495,582 | 1/1985 | Dessert et al. | 101/248 |
| 4,531,828 | 7/1985 | Hoshino | 101/181 |
| 4,553,478 | 11/1985 | Greiner et al. | 101/426 |
| 4,685,139 | 8/1987 | Masuda et al. | 382/1 |
| 4,694,749 | 9/1987 | Takeuchi et al. | 101/181 |
| 4,743,768 | 5/1988 | Watanabe | 250/556 |
| 4,805,111 | 2/1989 | Steidel | 101/181 |
| 4,872,407 | 10/1989 | Banke | 101/389.1 |
| 5,020,006 | 5/1991 | Sporon-Fiedler | 364/550 |
| 5,056,430 | 10/1991 | Bayerlein et al. | 101/211 |
| 5,179,897 | 1/1993 | Liebregts | 101/129 |
| 5,209,161 | 5/1993 | Derivi et al. | 101/211 |
| 5,252,838 | 10/1993 | Timblin | 250/561 |
| 5,272,980 | 12/1993 | Takeuchi et al. | 101/481 |
| 5,455,764 | 10/1995 | Meihofer | 101/248 |
| 5,551,339 | 9/1996 | Schädlich et al. | 101/216 |
| 5,649,484 | 7/1997 | Broghammer | 101/248 |

FOREIGN PATENT DOCUMENTS

| | | |
|---|---|---|
| 0 311 729 | 4/1989 | European Pat. Off. . |
| 27 02 274 | 7/1978 | Germany . |
| 56-28864 | 3/1981 | Japan . |
| 7808954 | 3/1980 | Netherlands . |
| 499198 | 3/1976 | Russian Federation . |
| 2 024 457 | 1/1980 | United Kingdom . |

*Primary Examiner*—Eugene H. Eickholt
*Attorney, Agent, or Firm*—Marshall, O'Toole, Gerstein, Murray & Borun

[57] ABSTRACT

A pre-registration system for a printing press may be provided with a first detector for detecting an angular position of a first rotatable printing cylinder by sensing when a reference mark disposed on the first printing cylinder is in a predetermined angular position, a second detector for detecting an angular position of a second printing cylinder by sensing when a reference mark of the second printing cylinder is in a predetermined angular position, and an adjustment mechanism for automatically adjusting the angular position of one of the printing cylinders based on the circumference, a web distance, and the angular position of one of the printing cylinders. The adjustment mechanism may adjust the angular position based upon a stored phase data relating to the web distance and the circumference. Alternatively, the adjustment mechanism may determine a target angular position for the one printing cylinder, determine a phase correction signal based upon the angular position of the one printing cylinder and the target angular position, and adjust the angular position of the printing cylinder based upon the phase correction signal.

24 Claims, 4 Drawing Sheets

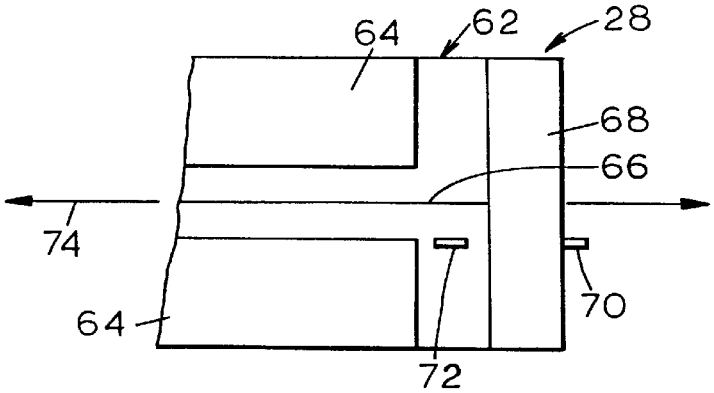
FIG. 2
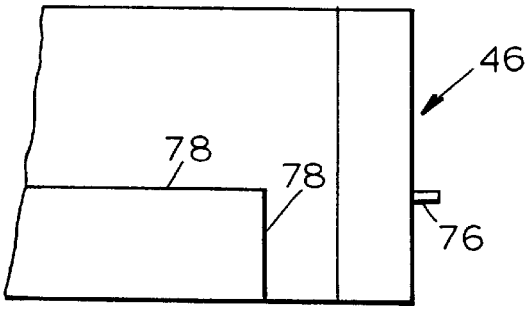
FIG. 3
| STATION | CIRCUMFERENCE | WEB DISTANCE |
|---|---|---|
| 1 | 20" | 615" |
| 2 | 20" | 320" |
207
FIG. 6A
| STATION | OFFSET |
|---|---|
| 1 | 15" |
| 2 | 0" |
207
FIG. 6B

PRE-REGISTRATION SYSTEM FOR A PRINTING PRESS

BACKGROUND OF THE INVENTION

The present invention is directed to a pre-registration system for a printing press in which the printing cylinders of the press are placed in proper registration relative to each other.

Color printing presses are typically provided with at least four print stations through which a web of paper or other material sequentially passes. Each printing station includes a rotating printing cylinder that prints an image in a single color on the web. The images printed by the printing cylinders must be properly aligned or registered so that each single-color image precisely overlays the other single-color images to form the desired multi-color image. To maintain proper alignment of the images, each printing cylinder must be maintained in a proper angular orientation with respect to the other printing cylinders.

Conventional printing presses include dynamic registration systems which maintain the proper registration of the printing cylinders during printing. However, for such dynamic registration systems to operate, the printing cylinders must be pre-registered so that they are in a substantially correct angular alignment relative to each other. This initial pre-registration is done by running the press so that the printing cylinders print single-color images on the web and then visually inspecting the alignment of the printed images. Depending on such alignment, the angular positions of the printing cylinders are adjusted, and the process is repeated until the press is placed in substantially correct registration. Such manual pre-registration is tedious, time-consuming and wastes the web material.

SUMMARY OF THE INVENTION

The invention is directed to a pre-registration system for a printing press adapted to print multi-color images on a web. The pre-registration system includes a first detector for detecting an angular position of a first rotatable printing cylinder by sensing when a reference mark disposed on the first printing cylinder is in a predetermined angular position, a second detector for detecting an angular position of a second printing cylinder by sensing when a reference mark of the second printing cylinder is in a predetermined angular position, and means for automatically adjusting the angular position of one of the printing cylinders based on the circumference of the printing cylinders, the angular position of one of the printing cylinders, and a web distance.

The adjusting means may include means for adjusting the angular position based upon stored phase data relating to the web distance and the circumference of the printing cylinders. Alternatively, the adjusting means may comprise means for determining a target angular position for one printing cylinder, means for determining a phase correction signal based upon the angular position of the printing cylinder and the target angular position, and a phase control unit operatively coupled to the printing cylinder for adjusting the angular position of the printing cylinder based upon the phase correction signal.

The pre-registration system may be incorporated in a printing press having a plurality of rotatable printing cylinders, each of which is adapted to print a single-color image on the web. Each printing cylinder may have a printing layer disposed thereon and a cylinder reference mark, the printing layer having a layer reference mark and being disposed on the printing cylinder so that the layer reference mark is in a predetermined alignment relative to the cylinder reference mark.

The invention is also directed to a method of pre-registering a printing press comprising the steps of: (a) applying a printing layer having a layer reference mark thereon to a first rotatable printing cylinder having a cylinder reference mark, the printing layer being disposed so that the layer reference mark is in a predetermined alignment relative to the cylinder reference mark; (b) applying a printing layer having a layer reference mark thereon to a second rotatable printing cylinder having a cylinder reference mark, the printing layer being disposed so that the layer reference mark is in a predetermined alignment relative to the cylinder reference mark; (c) detecting an angular position of the first printing cylinder by sensing when the reference mark disposed on the first printing cylinder is in a predetermined angular position; (d) detecting an angular position of the second printing cylinder by sensing when the reference mark of the second printing cylinder is in a predetermined angular position; and (e) automatically adjusting the angular position of one of the printing cylinders based on the circumference of the printing cylinders, the angular position of one of the printing cylinders, and a web distance.

Step (e) of the method may include the step of adjusting the angular position based upon stored phase data relating to the web distance and the printing cylinder circumference. Step (e) may also include the steps of: (e1) determining a target angular position for one printing cylinder, (e2) determining a phase correction signal based upon the angular position of the printing cylinder and the target angular position, and (e3) adjusting the angular position of the printing cylinder based upon the phase correction signal.

Step (a) of the method may include the step of applying the printing layer on the first printing cylinder so that the layer reference mark of the printing layer and the cylinder reference mark of the first printing cylinder are disposed in a line substantially parallel to a central axis of the first printing cylinder.

These and other features and advantages of the present invention will be apparent to those of ordinary skill in the art in view of the detailed description of the preferred embodiment, which is made with reference to the drawings, a brief description of which is provided below.

BRIEF DESCRIPTION OF THE DRAWINGS

FIG. 2 is a top view of a portion of one of the printing cylinders of the printing press of FIG. 1;

FIG. 3 is a top view of a portion of the die cut cylinder of the printing press of FIG. 1;

FIG. 6A shows registration data for printing station number, circumference of the printing cylinder and web distance between the printing cylinder and the die cut cylinder.

FIG. 6B shows alternately registration data for the printing station number and offset distance for registration between the printing cylinder and the die cut cylinder.

DETAILED DESCRIPTION OF A PREFERRED EMBODIMENT

Figure 1:
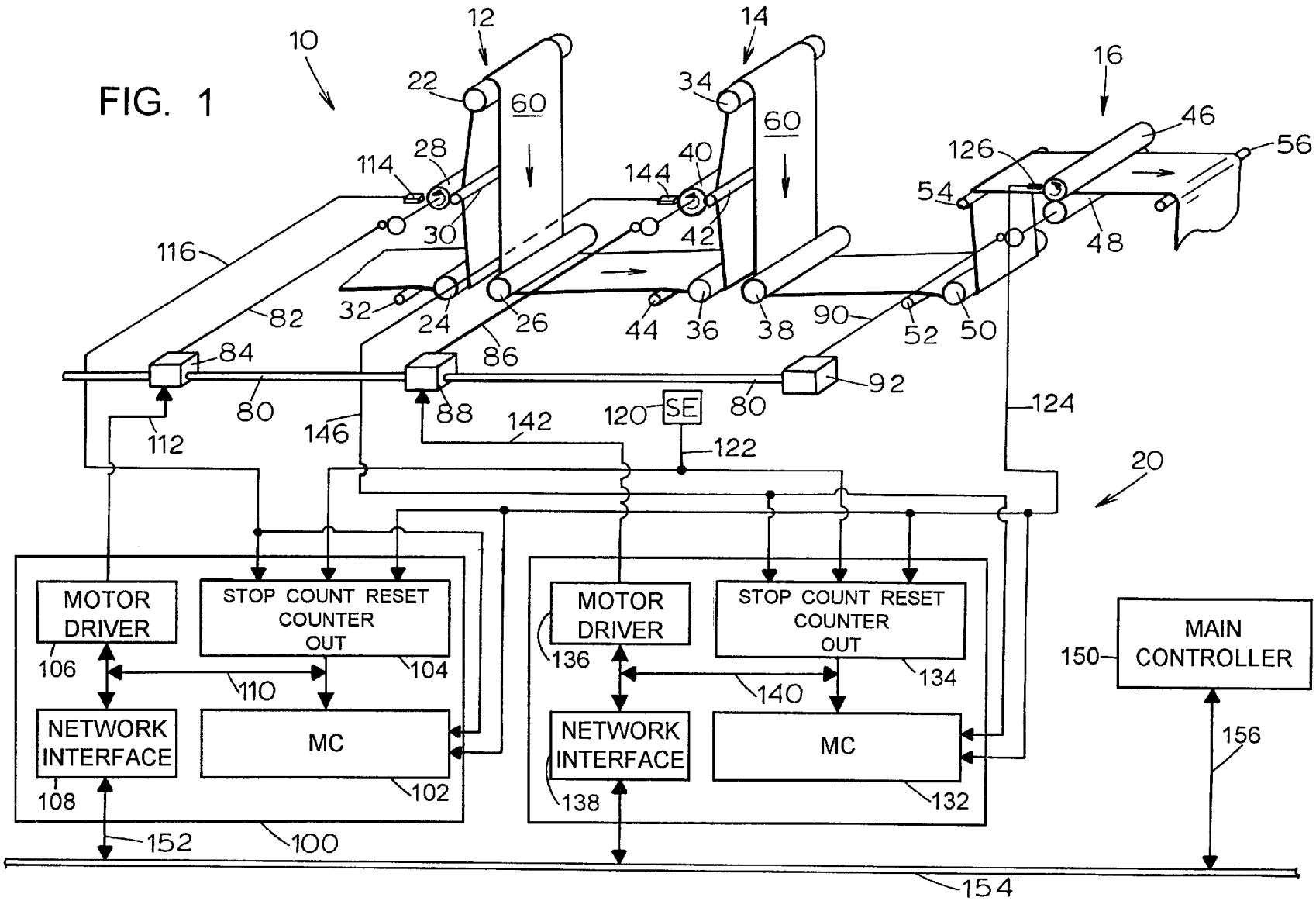
FIG. 1 illustrates a preferred embodiment of a printing press with a pre-registration system in accordance with the invention.

FIG. 1 illustrates a preferred embodiment of a printing press 10 with a pre-registration system 20 in accordance with the invention. Referring to FIG. 1, the printing press 10 includes a first printing station 12, a second printing station 14, and a cutting station 16. The first printing station 12 includes an upper pull roller 22, a pair of guide rollers 24, 26, a printing cylinder 28, and two rollers 30, 32. The second printing station 14 also includes an upper pull roller 34, a pair of guide rollers 36, 38, a printing cylinder 40, and two rollers 42, 44. The cutting station 16 includes a die cut cylinder 46, a die anvil cylinder 48, a guide roller 50, and three rollers 52, 54, 56. The particular structure of the printing press 10 described above is not considered important to the invention, and the press 10 may have other configurations.

A portion of a web 60, such as paper, is shown to pass successively from the first printing station 12, to the second printing station 14, and to the cutting station 16 in the direction indicated by the arrows. During normal printing operation, as the web 60 passes through the first printing station 12, images in a first color are printed on the web 60 by the printing cylinder 28. As the web 60 passes through the second printing station 14, images in a second color are printed on the web 60 by the printing cylinder 40 in alignment or registration with the images previously printed by the cylinder 28. As the web 60 passes through the cutting station 16, a cut or pattern of cuts is made in the web 60 by the die cut cylinder 46, the cut or pattern of cuts being in precise alignment with the multi-color image previously printed on the web 60.

It should be understood that while only two printing stations are shown, a multi-color printing press typically has at least four printing stations, each of which prints images on the web 60 in a different color.

FIG. 2 is a top view of a portion of the printing cylinder 28. Referring to FIG. 2, where the printing press 10 is a flexo-graphic press or a web-offset press, the printing cylinder 28 has a printing layer in the form of a plate 62 mounted thereon, and the printing plate 62 has an area 64 in which printing elements are formed so that a desired image is printed on the web 60. Where the printing press 10 is a flexographic press, the printing elements constitute raised areas (e.g. raised 1/16 of an inch with respect to the outer surface of the plate 62) which are inked once per revolution of the cylinder 28, with the image printed on the web 60 corresponding to the pattern of raised areas on the plate 62. Where the printing press 10 is a web-offset press, the printing elements constitute ink-attracting areas on the surface of the printing plate 62 which form the desired image.

The printing plate 62 is rectangular in shape and is wrapped around the cylinder 28 so that its ends meet at a seam 66. Alternatively, a seamless printing plate may be used. The printing plate 62 may be mounted to the cylinder 28 manually or with the aid of a conventional machine. The printing cylinder 28 has an end portion 68 having a reference mark 70, and the printing plate 62 has a reference mark 72, which may consist of a relatively small number of the type of printing elements, as described above, which are provided in the printing area 64 of the printing plate 62.

The printing plate 62 is applied or mounted to the printing cylinder 28 so that the reference mark 72 of the plate 62 is aligned in a predetermined positioned relative to the reference mark 70 of the printing cylinder 68. This alignment may be made so that the reference marks 70, 72 are disposed in a line substantially parallel to the central axis of the printing cylinder 28, which axis is represented in FIG. 2 by a line 74. The printing cylinder 40 of the second printing station 14 has the same construction as the cylinder 28 shown in FIG. 2.

Where the printing press 10 is a gravure press, instead of a printing plate, the printing layer is composed of a thin metal coating applied to the printing cylinder 28 in a conventional manner. After being applied to the cylinder 28, the metal coating is etched in a conventional manner to form numerous, very small recesses referred to as "gravure cells" which are filled with a particular color of ink upon each revolution of the cylinder 28. The ink contained in the gravure cells is transferred to the web 60 as the web 60 makes contact with the printing cylinder 28. A number of the gravure cells etched into the metal coating form a reference mark which, like the reference mark 72 described above, is disposed in a predetermined positioned relative to the reference mark 70 of the printing cylinder 68. To prepare the printing cylinders for a new print job, the previously etched metal coatings are removed from the printing cylinders in a conventional manner, and then new metal coatings are formed thereon and etched with new patterns of gravure cells.

A top view of a portion of the die cut cylinder 46 of the cutting station 16 is shown in FIG. 3. The die cut cylinder 46 has a reference mark 76 which is aligned or registered relative to a number of raised cutting edges 78 formed on the surface of the cylinder 46.

Referring back to FIG. 1, the printing cylinder 28 of the first printing station 12 is rotatably driven by a main drive shaft 80 operatively coupled to the printing cylinder 28 through a secondary drive shaft 82 and a phase control unit 84 for controlling the angular relationship or phase between the main drive shaft 80 and the secondary drive shaft 82. Similarly, the printing cylinder 40 of the second printing station 14 is rotatably driven, at the same rotational rate as the printing cylinder 28, via a secondary drive shaft 86 coupled to the main drive shaft 80 via a phase control unit 88.

The die anvil cylinder 48 is rotatably driven at the same rotational rate as the printing cylinders 28, 40 via a secondary drive shaft 90 connected to a phase control unit 92. The die anvil cylinder 48 and the die cut cylinder 46 are interconnected by a gearing system (not shown) which causes the die cut cylinder 46 to be driven at the same rate as the die anvil cylinder 48.

The angular position of the printing cylinder 28 of the first printing station 12 is controllably adjusted relative to the angular position of the die cut cylinder 46 via a printing station controller 100 operatively connected to the first printing station 12. The station controller 100 includes a microcontroller (MC) 102, a counter circuit 104, a motor driver circuit 106, and a network interface circuit 108, all of which are interconnected via an internal address/data link 110. The microcontroller 102 incorporates conventional hardware elements (not shown) including a memory for storing a computer program and a microprocessor for executing the program.

The motor driver circuit 106 is coupled to the phase control unit 84 via a multi-signal line 112 on which a number of motor drive signals are generated. The motor drive signals drive a motor (not shown) in the phase control unit 84 that varies the angular position or phase of the secondary drive shaft 82 relative to the main drive shaft 80.

The microcontroller 102 and the stop counting input of the counter 104 are both connected to a sensor 114 via a line 116. The sensor 114, which may be any type of conventional sensor, senses each time the reference mark 70 on the printing cylinder 28 passes the sensor 114 and generates a detection signal in response thereto.

The count input of the counter 104 is connected to a shaft encoder (SE) sensor 120 operatively coupled to the main drive shaft 80 via a line 122. When the main drive shaft 80 is in motion, the shaft encoder sensor 120 generates a large number of pulses on the line 122 corresponding to the rotation of the drive shaft 80. The number of pulses, which are counted by the counter 104, are set to correspond to a predetermined increment of web movement. For example, the shaft encoder 120 may be calibrated to generate 1,000 pulses per inch of movement of the web 60.

The microcontroller 102 and the reset input of the counter 104 are both connected to receive via a line 124 a reset signal generated by a sensor 126 that detects the passage of the reference mark 76 of the die cut cylinder 46.

The angular position of the printing cylinder 40 of the second printing station 14 is controllably adjusted relative to the angular position of the die cut cylinder 46 via a printing station controller 130 operatively connected to the second printing station 14. The station controller 130 includes a microcontroller 132, a counter circuit 134, a motor driver circuit 136, and a network interface circuit 138, all of which are interconnected via an internal address/data link 140. The microcontroller 132 incorporates conventional hardware elements (not shown) including a memory for storing a computer program and a microprocessor for executing the program.

The motor driver circuit 136 is coupled to the phase control unit 88 via a multi-signal line 142 on which a number of motor drive signals are generated. The motor drive signals drive a motor (not shown) in the phase control unit 88 that varies the angular position of the secondary drive shaft 86 relative to the main drive shaft 80.

The microcontroller 132 and the stop counting input of the counter 134 are both connected to a sensor 144 via a line 146. The sensor 144 senses each time the metal reference mark on the printing cylinder 40 passes by and generates a detection signal in response thereto. The count input of the counter 134 is connected to count the pulses generated by the shaft encoder sensor 120, as described above, and the microcontroller 132 and the reset input of the counter 134 are both connected to receive the reset signal generated by the sensor 126.

The station controller 100 is connected to a main controller 150 via a data link 152 connected to the network interface 108, a communication link 154 connected to the data link 152, and a data link 156 connected between the communication link 154 and the main controller 150. The station controller 130 is connected to the main controller 150 via a data link 158, the communication link 154, and the data link 156. The communication protocol between the main controller 150 and the station controllers 100, 130 may be a conventional one, such as an Ethernet-based communication protocol.

The main controller 150 may comprise a conventional personal computer having a microprocessor, a random access memory, a read-only memory, an input/output circuit, all of which are interconnected by an address/data bus in a conventional manner. The main controller 150 may also include a display device for displaying information to the press operator and an input device, such as a keyboard or mouse, for receiving commands from the operator, the display and input devices being connected to the input/output circuit of the main controller 150 via separate data lines.

Operation

The operation of the pre-registration system 20 is controlled by a computer program routine 200 executed by the main controller 150 and a computer program routine 250 executed by each of the station controllers 100, 130. Prior to the normal operation of the press 10, the operator may initiate the routines 200, 250 to cause the printing cylinders 28, 40 and the die cut cylinder 46 to automatically be placed in proper registration relative to each other.

When the operator requests that the press 10 be placed in proper registration, by inputting a pre-registration command to the main controller 150, the main controller 150 requests that the operator cause the printing cylinders 28, 40 and the die cut cylinder 46 to rotate at a relatively slow speed (which is accomplished via drive signals transmitted to a motor (not shown) connected to the drive shaft 80).

Figure 4:
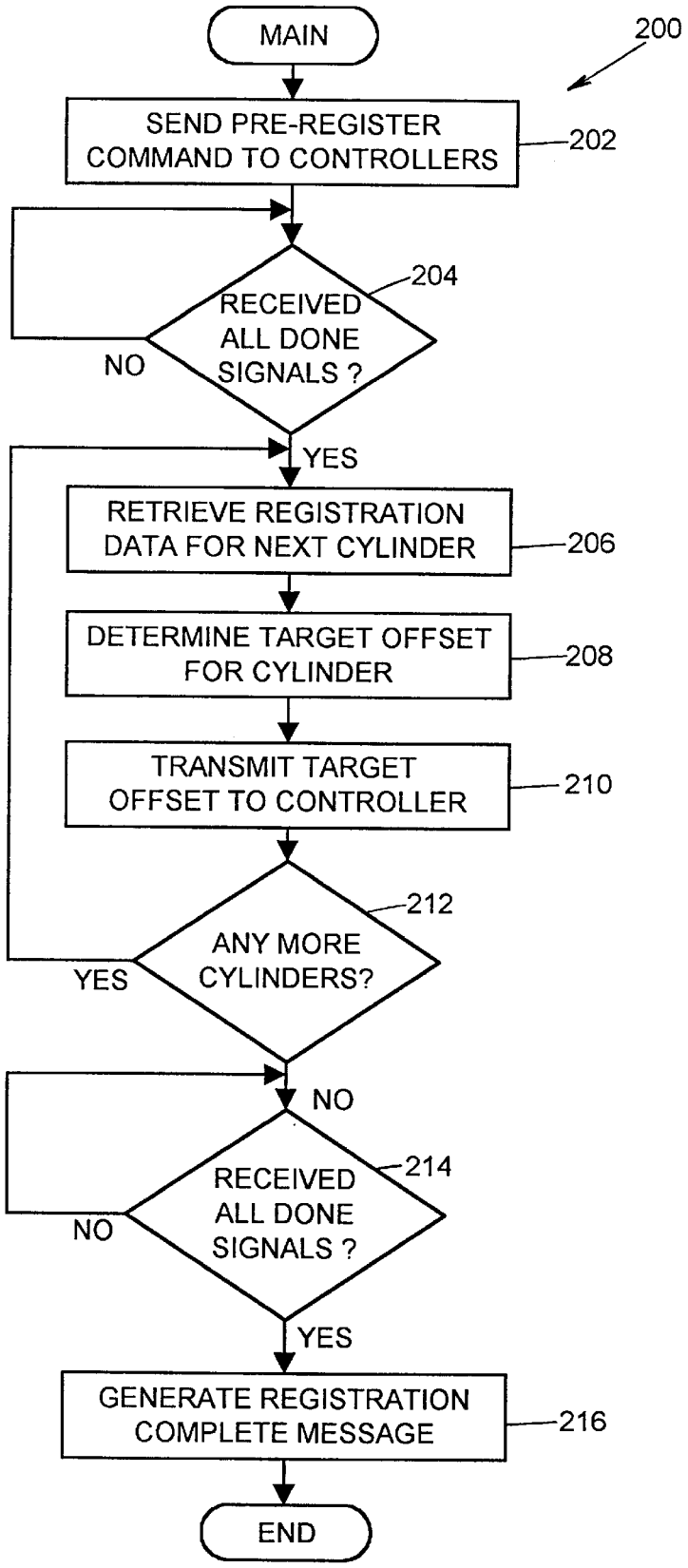
FIG. 4 is a flowchart of a routine performed by the main controller of the pre-registration system.
Figure 5:
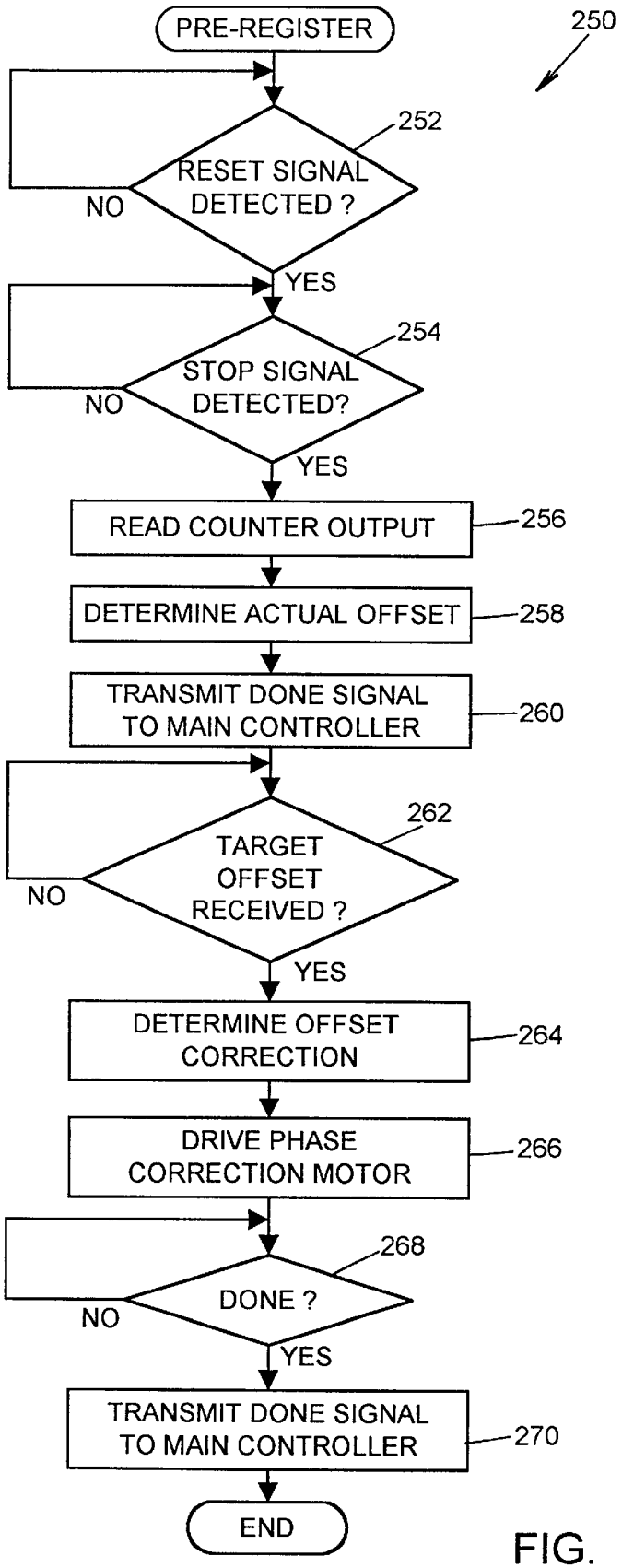
FIG. 5 is a flowchart of a routine performed by each printing station controller of the pre-registration system.

Referring to FIG. 4, at step 202 the main controller 150 then transmits a pre-registration command to each of the station controllers 100, 130 via the communication link 154. Referring to FIG. 5, when each station controller 100, 130 receives the pre-registration command from the main controller 150, each station controller 100, 130 initiates the pre-register routine 250 to begin the pre-registration process. At step 252, the routine waits until the reset signal generated on the line 124 by the die cut sensor 126 is detected. When the reset signal is detected, the routine branches to step 254 where it waits until the stop signal generated by its associated sensor 114 or 144 is detected. When the stop signal is detected, the routine branches to step 256 where the output of its associated counter 104 or 134 is read.

At step 258, the offset distance is determined based on the count that was read during step 256. For example, if the shaft encoder sensor 120 is calibrated to generate 1,000 pulses per inch of web travel and if the counter was stopped at 4,000 pulses, the offset distance between the die cut cylinder and the printing cylinder would be 4 inches. If the circumference of the cylinders was 20 inches, this offset distance of four inches would correspond to an angular phase difference between the two cylinders of 72°. After the offset distance is determined, at step 260 a done signal is transmitted to the main controller 150 to indicate that the station controller has determined the offset distance.

Referring back to FIG. 4, at step 204 the main controller 150 waits until it receives the done signals from all of the station controllers 100, 130. When it does, the main controller 150 may signal the operator to cause the drive shaft 80 to stop so that the cylinders 28, 40, 46 stop rotating. Then, at step 206, the main controller 150 retrieves, from a portion of its memory 207 (FIG. 6A), the registration data for the next (or first) printing cylinder to be pre-registered.

Referring to FIG. 6A, the registration data may include the printing station number, the circumference of the printing cylinder, and the web distance between that printing cylinder and the die cut cylinder 46. Alternatively, as shown in FIG. 6B, the registration data may simply include the printing station number and the offset distance (a numeric value or factor representing the offset distance) needed to place each printing cylinder in proper registration or phase with respect to the die cut cylinder 46.

Referring back to FIG. 4, if the registration data is in the format of FIG. 6A, at step 208 the target offset needed to place the cylinders in proper registration or phase is determined by dividing the web distance by the circumference, with the remainder being the target offset, which can be expressed either as an offset distance or an angular offset. For the registration data of FIG. 6A, the offset distance for station 1 would be 15 inches (the angular offset would be 270°). If the registration data was in the form of FIG. 6B, step 208 would be skipped. At step 210, the target offset determined for that particular cylinder is transmitted to the station controller which controls the phase of that cylinder. At step 212, if the target offset has not been determined for all of the printing cylinders, the routine branches back to step 206 so that steps 206–210 can be performed for the next printing cylinder.

Referring to FIG. 5, at step 262, if the target offset has been received from the main controller 150, the routine branches to step 264 where an offset or phase correction is determined by determining the difference between the target offset and the actual offset determined at step 258. Based upon this difference, at step 266 the motor in the associated phase control unit is driven (via motor drive signals generated on one of the lines 112 or 142) so that the phase of the associated printing cylinder is placed in proper phase relative to the die cut cylinder 46. At step 268, when the motor in the associated phase control unit has finished adjusting the angular position of the printing cylinder, the routine branches to step 270 where a done signal is transmitted to the main controller 150 to indicate that the printing cylinder has been placed in proper phase.

Referring back to FIG. 4, at step 214, when the main controller 150 receives a done signal from each of the station controllers 100, 130, the program branches to step 216 where a pre-registration complete message is generated on the display of the main controller 150.

After the pre-registration process described above is performed, the process can optionally be repeated once to confirm that the cylinders 28, 40, 46 are in proper registration.

Although the pre-registration system 20 described above is implemented with a station controller for each printing station and a main controller connected to each of the station controllers, the pre-registration system could be implemented with a single controller. It should also be appreciated that, while the angular positions of the printing cylinders are adjusted relative to the die cut cylinder, which is effectively used as a reference cylinder, as described above, the pre-registration system of the invention could be used to register only the printing cylinders of a printing press. In such case, one of the cylinders could be used as a reference cylinder, and the angular position or phase of the other printing cylinders could be adjusted relative to the reference printing cylinder.

Initial Calibration

As described above, the pre-registration system 20 automatically places the printing cylinders 28, 40 in proper initial registration based upon the circumference of the printing cylinders 28, 40 and the web distance between each of the printing cylinders 28, 40 and a reference cylinder 46. The web distances could be determined simply by measuring them. However, if the web distances cannot be precisely determined based upon measurement, they could be automatically determined in accordance with an initial calibration procedure, based upon estimates of the web distances and an initial, manual pre-registration, as described below.

First, the circumference of the printing cylinders 28, 40 and an estimate of the web distance for each cylinder are input to the main controller 150 by the operator. The estimates of the web distances need to be accurate to at least within one-half the circumference of the printing cylinders 28, 40. Based upon the estimated web distances and the cylinder circumference, the pre-registration system 20 determines an estimated offset for each cylinder in the manner described above in connection with step 208.

Then, the printing cylinders 28, 40 are manually placed in registration in accordance with current practice. After the cylinders 28, 40 are manually placed in registration, the actual offset associated with each of the printing cylinders 28, 40 is determined in accordance with steps 252–258 described above. The differences between each actual offset and the offset calculated based on the estimate of each web distance are determined, and each such difference is added to each corresponding estimated web distance to determine each actual web distance.

To illustrate the above procedure, assume that the printing cylinder 40 has a circumference of 20 inches, that the operator estimates that the web distance between that cylinder and the reference cylinder 46 is 205 inches, and that web distance is actually 210 inches. The estimated web offset determined by the system would then be five inches, and the actual offset (after the cylinder 40 was manually placed in registration) would be 10 inches. To determine the actual web distance, the pre-registration system 20 adds the difference between the actual offset and the estimated offset, five inches, to the estimated web distance of 205 inches.

The actual web distances determined in the above manner are preferably stored in a permanent or non-volatile memory in the pre-registration system 20. It should be noted that, although the printing press 10 may have to be manually registered once to determine the actual web distances, it will not need to be manually registered again, whereas conventional printing presses need to be manually registered each time printing layers are applied to the printing cylinders for a new print job.

Once the actual web distances are stored in memory, the pre-registration system 20 can automatically pre-register cylinders of any circumference (which circumference would be input by the operator) since the proper offsets are determinable from the actual web distances and the cylinder circumference.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A printing press, comprising:

a die cut cylinder having a circumference and being adapted to form a cut in a web, said die cut cylinder having a raised cutting edge and a reference mark;

a first rotatable printing cylinder adapted to print an image on said web, said first printing cylinder being spaced from said die cut cylinder by a first web distance, said first printing cylinder having a circumference substantially the same as said circumference of said die cut cylinder, said first printing cylinder having a printing layer disposed thereon and a cylinder reference mark, said printing layer having a layer a reference mark and being disposed on said first printing cylinder so that said layer reference mark is in a predetermined alignment relative to said cylinder reference mark;

a second rotatable printing cylinder adapted to print an image on said web, said second printing cylinder being spaced from said die cut cylinder by a second web distance, said second printing cylinder having a circumference substantially the same as said circumference of said die cut cylinder, said second printing cylinder having a printing layer disposed thereon and a cylinder reference mark, said printing layer disposed on said second printing cylinder having a layer reference mark and being positioned on said second printing cylinder so that said layer reference mark of said printing layer disposed on said second printing cylinder is in a predetermined alignment relative to said cylinder reference mark of said second printing cylinder;

a first detector for detecting an angular position of said first printing cylinder by sensing when said reference mark disposed on said first printing cylinder is in a predetermined angular position;

a second detector for detecting an angular position of said second printing cylinder by sensing when said reference mark of said second printing cylinder is in a predetermined angular position;

a third detector for detecting an angular position of said die cut cylinder by sensing when said reference mark of said die cut cylinder is in a predetermined angular position;

means for automatically adjusting said angular position of said first printing cylinder relative to said angular position of said die cut cylinder based on said circumference, said first web distance, and said angular positions of said die cut cylinder and said first printing cylinder; and means for automatically adjusting said angular position of said second printing cylinder relative to said angular position of said die cut cylinder based on said circumference, said second web distance, and said angular positions of said die cut cylinder and said second printing cylinder.

2. A printing press as defined in claim 1 wherein said means for automatically adjusting said angular position of said first printing cylinder comprises:

means for determining a target angular position for said first printing cylinder based upon said circumference, said first web distance, and said angular position of said die cut cylinder; and means for generating a phase correction signal based upon said angular position of said first printing cylinder and said target angular position; and a phase control unit operatively coupled to said first printing cylinder for adjusting the angular position of said first printing cylinder based upon said phase correction signal.

3. A printing press as defined in claim 1 wherein said cylinder reference mark of said first printing cylinder and said layer reference mark of said printing layer disposed on said first printing cylinder are disposed in a line substantially parallel to a central axis of said first printing cylinder.

4. A printing press as defined in claim 1 wherein said cylinder reference mark of said first printing cylinder comprises a raised portion on said first printing cylinder.

5. A printing press as defined in claim 1 wherein said layer reference mark of said printing layer disposed on said first printing cylinder comprises a group of gravure cells.

6. A printing press as defined in claim 1 wherein said means for automatically adjusting said angular position of said first printing cylinder relative to said angular position of said die cut cylinder comprises means for adjusting said angular position based upon data relating to said first web distance and said circumference.

7. A printing press as defined in claim 1 wherein said means for automatically adjusting said angular position of said first printing cylinder relative to said angular position of said die cut cylinder comprises means for determining said angular position of said first printing cylinder relative to said angular position of said die cut cylinder.

8. A printing press as defined in claim 7 wherein said means for determining said angular position of said first printing cylinder relative to said angular position of said die cut cylinder comprises a counter.

9. A printing press adapted to print images on a web, said printing press comprising:

a first rotatable printing cylinder having a circumference and being adapted to print an image on a web, said first printing cylinder having a printing layer disposed thereon and a cylinder reference mark, said printing layer having a layer reference mark and being positioned on said first printing cylinder so that said layer reference mark is in a predetermined alignment relative to said cylinder reference mark;

a second rotatable printing cylinder adapted to print an image on said web, said second printing cylinder having a circumference substantially the same as said circumference of said first printing cylinder, said second printing cylinder having a printing layer disposed thereon and a cylinder reference mark, said printing layer disposed on said second printing cylinder having a layer reference mark and being positioned on said second printing cylinder so that said layer reference mark of said printing layer disposed on said second printing cylinder is in a predetermined alignment relative to said cylinder reference mark of said second printing cylinder, one of said rotatable printing cylinders being spaced from a point within the printing press by a distance along said web;

a first detector for detecting an angular position of said first printing cylinder by sensing when said reference mark disposed on said first printing cylinder is in a predetermined angular position;

a second detector for detecting an angular position of said second printing cylinder by sensing when said reference mark of said second printing cylinder is in a predetermined angular position; and means for automatically adjusting said angular position of one of said printing cylinders based on said circumference, said web distance, and said angular position of one of said printing cylinders.

10. A printing press as defined in claim 9 wherein said means for automatically adjusting said angular position of one of said printing cylinders comprises means for adjusting said angular position based upon stored data relating to said web distance and said circumference.

11. A printing press as defined in claim 9 wherein said means for automatically adjusting said angular position of one of said printing cylinders comprises:

means for determining a target angular position for said one printing cylinder;

means for generating a phase correction signal based upon said angular position of said one printing cylinder and said target angular position; and a phase control unit operatively coupled to said one printing cylinder for adjusting the angular position of said one printing cylinder based upon said phase correction signal.

12. A printing press as defined in claim 9 wherein said cylinder reference mark of said first printing cylinder and said layer reference mark of said printing layer disposed on said first printing cylinder are disposed in a line substantially parallel to a central axis of said first printing cylinder.

13. A printing press as defined in claim 9 wherein said cylinder reference mark of said first printing cylinder comprises a raised portion on said first printing cylinder.

14. A printing press as defined in claim 9 wherein said layer reference mark of said printing layer disposed on said first printing cylinder comprises a gravure cell.

15. A pre-registration system for a printing press adapted to print images on a web and having a plurality of rotatable printing cylinders, one of which is spaced from a point within the printing press by a web distance, said pre-registration system comprising:

a first detector for detecting an angular position of a first rotatable printing cylinder having a circumference by sensing when a reference mark associated with said first printing cylinder is in a predetermined angular position;

a second detector for detecting an angular position of a second printing cylinder having a circumference by sensing when a reference mark associated with said second printing cylinder is in a predetermined angular position; and means for automatically adjusting said angular position of one of said printing cylinders based on said circumference, said web distance, and said angular position of one of said printing cylinders.

16. A printing press as defined in claim 15 wherein said means for automatically adjusting said angular position of one of said printing cylinders comprises means for adjusting said angular position based upon stored data relating to said web distance and said circumference.

17. A printing press as defined in claim 15 wherein said means for automatically adjusting said angular position of one of said printing cylinders comprises:

means for determining a target angular position for said one printing cylinder;

means for determining a phase correction signal based upon said angular position of said one printing cylinder and said target angular position; and a phase control unit operatively coupled to said one printing cylinder for adjusting the angular position of said one printing cylinder based upon said phase correction signal.

18. A method of pre-registering a printing press comprising the steps of:

(a) applying a printing layer to a first rotatable printing cylinder having a circumference and being adapted to print an image on a web, said first printing cylinder having a cylinder reference mark and said printing layer having a layer reference mark, said printing layer being disposed so that said layer reference mark is in a predetermined alignment relative to said cylinder reference mark;

(b) applying a printing layer to a second rotatable printing cylinder having a circumference and being adapted to print an image on a web, said second printing cylinder having a cylinder reference mark and said printing layer having a layer reference mark, said printing layer being disposed so that said layer reference mark is in a predetermined alignment relative to said cylinder reference mark, one of said rotatable printing cylinders being spaced from a point within the printing press by a web distance;

(c) detecting an angular position of said first printing cylinder by sensing when said reference mark disposed on said first printing cylinder is in a predetermined angular position;

(d) detecting an angular position of said second printing cylinder by sensing when said reference mark of said second printing cylinder is in a predetermined angular position; and (e) automatically adjusting said angular position of one of said printing cylinders based on said circumference, said web distance, and said angular position of one of said printing cylinders.

19. A method as defined in claim 18 wherein said step (e) comprises the step of adjusting said angular position based upon stored data relating to said web distance and said circumference.

20. A method as defined in claim 18 wherein said step (e) comprises the steps of:

(e1) determining a target angular position for said one printing cylinder;

(e2) generating a phase correction signal based upon said angular position of said one printing cylinder and said target angular position; and (e3) adjusting the angular position of said one printing cylinder based upon said phase correction signal.

21. A method as defined in claim 18 wherein said step (a) comprises the step of applying said printing layer on said first printing cylinder so that said layer reference mark of said printing layer and said cylinder reference mark of said first printing cylinder are disposed in a line substantially parallel to a central axis of said first printing cylinder.

22. A printing press adapted to print images on a web, said printing press comprising:

a first rotatable printing cylinder having a circumference and being adapted to print an image on a web, said first printing cylinder having a reference mark associated therewith;

a second rotatable printing cylinder adapted to print an image on said web, said second printing cylinder having a circumference substantially the same as said circumference of said first printing cylinder, said second printing cylinder having a reference mark associated therewith, one of said rotatable printing cylinders being spaced from a point within the printing press by a distance along said web;

a first detector for detecting an angular position of said first printing cylinder by sensing when said reference mark associated with said first printing cylinder is in a predetermined angular position;

a second detector for detecting an angular position of said second printing cylinder by sensing when said reference mark associated with said second printing cylinder is in a predetermined angular position; and means for automatically adjusting said angular position of one of said printing cylinders based on said circumference, said web distance, and said angular position of one of said printing cylinders.

23. A printing press as defined in claim 22 wherein said means for automatically adjusting said angular position of one of said printing cylinders comprises means for adjusting said angular position based upon stored data relating to said web distance and said circumference.

24. A printing press as defined in claim 22 wherein said means for automatically adjusting said angular position of one of said printing cylinders comprises:

means for determining a target angular position for said one printing cylinder;

means for generating a phase correction signal based upon said angular position of said one printing cylinder and said target angular position; and a phase control unit operatively coupled to said one printing cylinder for adjusting the angular position of said one printing cylinder based upon said phase correction signal.

* * * * *